US008771097B2

(12) United States Patent
Bennett et al.

(10) Patent No.: US 8,771,097 B2
(45) **Date of Patent: *Jul. 8, 2014**

(54) GOLF CLUB WITH TROUGH IN SOLE

(71) Applicant: Cobra Golf Incorporated, Carlsbad, CA (US)

(72) Inventors: Thomas Orrin Bennett, Carlsbad, CA (US); Thomas C. Morris, Carlsbad, CA (US); Thomas W. Preece, San Diego, CA (US); Douglas E. Roberts, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/709,604

(22) Filed: Dec. 10, 2012

(65) Prior Publication Data

US 2013/0095952 A1 Apr. 18, 2013

Related U.S. Application Data

(63) Continuation of application No. 12/570,725, filed on Sep. 30, 2009, now Pat. No. 8,328,658.

(51) Int. Cl.
*A63B 53/04* (2006.01)
*A63B 53/06* (2006.01)

(52) U.S. Cl.
USPC ..... 473/246; 473/248; 473/327; 473/345

(58) Field of Classification Search
USPC ..... 473/324–350
See application file for complete search history.

(56) References Cited

U.S. PATENT DOCUMENTS

| | | | | | |
|---|---|---|---|---|---|
| D44,457 | S | * | 8/1913 | Taylor, Jr. | D21/751 |
| 1,089,881 | A | * | 3/1914 | Taylor, Jr. | 473/328 |
| 1,128,288 | A | * | 2/1915 | Churchill | 473/328 |
| 1,505,296 | A | * | 8/1924 | Smith | 473/328 |
| 1,531,821 | A | * | 3/1925 | Scott | 473/328 |
| 1,669,482 | A | * | 5/1928 | Miller | 473/328 |
| 2,041,676 | A | * | 5/1936 | Gallagher | 473/327 |
| 3,068,011 | A | * | 12/1962 | Sano | 473/328 |
| 3,830,503 | A | * | 8/1974 | Consoli | 473/328 |

(Continued)

FOREIGN PATENT DOCUMENTS

| | | | | | |
|---|---|---|---|---|---|
| JP | 05007637 | A | * | 1/1993 | A63B 53/04 |
| JP | 2003000771 | A | * | 1/2003 | A63B 53/04 |
| JP | 2004049802 | A | * | 2/2004 | A63B 53/04 |
| JP | 2011072787 | A | * | 4/2011 | |

OTHER PUBLICATIONS

Jackson, Jeff. The Modern Guideto Golf Clubmaking. Ohio: Dynacraft Golf Products, Inc., copyright 1994, pp. 236, 237.*

*Primary Examiner* — Alvin Hunter
(74) *Attorney, Agent, or Firm* — Mark S. Leonardo; Brown Rudnick LLP

(57) ABSTRACT

A golf club with a plurality of protrusions separated by a trough and capable of improving turf interaction for various turf conditions with various turf undulations is disclosed herein. More specifically, the present invention discloses a metal wood type golf club having a plurality of protrusions separated by a trough on its sole that is capable of changing the lie angle of the metal wood type golf club head by varying the combination of protrusions that come into contact with the ground to provide improved turf interaction for various types of lies.

13 Claims, 9 Drawing Sheets

(56) References Cited

U.S. PATENT DOCUMENTS

| | | | | | |
|---|---|---|---|---|---|
| 3,980,301 | A * | 9/1976 | Smith | 473/314 |
| 3,997,170 | A * | 12/1976 | Goldberg | 473/327 |
| 4,065,133 | A * | 12/1977 | Gordos | 473/327 |
| 4,332,388 | A * | 6/1982 | Crow | 473/328 |
| 4,498,673 | A * | 2/1985 | Swanson | 473/328 |
| 4,750,537 | A * | 6/1988 | Green | 144/363 |
| 4,804,184 | A * | 2/1989 | Maltby | 473/409 |
| 4,948,132 | A * | 8/1990 | Wharton | 473/246 |
| 5,083,780 | A * | 1/1992 | Walton et al. | 473/320 |
| 5,125,662 | A * | 6/1992 | Antonious | 473/314 |
| 5,197,733 | A * | 3/1993 | Schroder | 473/314 |
| 5,213,329 | A * | 5/1993 | Okumoto et al. | 473/328 |
| 5,257,786 | A * | 11/1993 | Gorman | 473/349 |
| 5,286,027 | A * | 2/1994 | Koumarianos | 473/328 |
| 5,333,862 | A * | 8/1994 | Teramoto et al. | 473/314 |
| 5,340,106 | A * | 8/1994 | Ravaris | 473/328 |
| 5,380,009 | A * | 1/1995 | Henry et al. | 473/346 |
| 5,390,924 | A * | 2/1995 | Antonious | 473/328 |
| 5,441,263 | A * | 8/1995 | Gorman | 473/349 |
| 5,456,469 | A * | 10/1995 | MacDougall | 473/328 |
| 5,497,995 | A * | 3/1996 | Swisshelm | 473/350 |
| 5,513,844 | A * | 5/1996 | Ashcraft et al. | 473/288 |
| 5,544,884 | A * | 8/1996 | Hardman | 473/327 |
| 5,603,668 | A * | 2/1997 | Antonious | 473/328 |
| 5,626,528 | A * | 5/1997 | Toulon | 473/248 |
| 5,643,107 | A * | 7/1997 | Gorman | 473/328 |
| 5,658,206 | A * | 8/1997 | Antonious | 473/328 |
| 5,704,851 | A * | 1/1998 | Lucetti | 473/328 |
| 5,749,793 | A * | 5/1998 | Lucetti | 473/324 |
| 5,935,020 | A * | 8/1999 | Stites et al. | 473/345 |
| 6,048,278 | A * | 4/2000 | Meyer et al. | 473/345 |
| 6,056,649 | A * | 5/2000 | Imai | 473/328 |
| 6,123,627 | A * | 9/2000 | Antonious | 473/327 |
| 6,149,533 | A * | 11/2000 | Finn | 473/336 |
| 6,257,991 | B1 * | 7/2001 | Ortiz | 473/309 |
| 6,352,482 | B1 * | 3/2002 | Jacobson et al. | 473/310 |
| 6,354,962 | B1 * | 3/2002 | Galloway et al. | 473/342 |
| 6,368,230 | B1 * | 4/2002 | Helmstetter et al. | 473/244 |
| 6,371,868 | B1 * | 4/2002 | Galloway et al. | 473/324 |
| 6,416,422 | B1 * | 7/2002 | Nagai et al. | 473/328 |
| 6,435,977 | B1 * | 8/2002 | Helmstetter et al. | 473/290 |
| 6,435,978 | B1 * | 8/2002 | Galloway et al. | 473/305 |
| 6,435,980 | B1 * | 8/2002 | Reyes et al. | 473/324 |
| 6,471,604 | B2 * | 10/2002 | Hocknell et al. | 473/334 |
| 6,517,449 | B2 * | 2/2003 | Otoguro | 473/328 |
| 6,575,843 | B2 * | 6/2003 | McCabe | 473/245 |
| 6,605,007 | B1 * | 8/2003 | Bissonnette et al. | 473/329 |
| 6,663,503 | B1 * | 12/2003 | Kenmi | 473/328 |
| 6,716,114 | B2 * | 4/2004 | Nishio | 473/314 |
| 6,769,994 | B2 * | 8/2004 | Boone | 473/245 |
| 6,849,002 | B2 * | 2/2005 | Rice | 473/244 |
| 6,875,130 | B2 * | 4/2005 | Nishio | 473/345 |
| 6,887,163 | B2 * | 5/2005 | Blankenship | 473/310 |
| 6,913,546 | B2 * | 7/2005 | Kakiuchi | 473/345 |
| 6,964,617 | B2 * | 11/2005 | Williams | 473/245 |
| 7,066,830 | B2 * | 6/2006 | Day | 473/324 |
| 7,115,046 | B1 * | 10/2006 | Evans | 473/307 |
| 7,258,623 | B2 * | 8/2007 | Halleck et al. | 473/308 |
| 7,285,060 | B2 * | 10/2007 | Williams | 473/407 |
| 7,618,330 | B2 * | 11/2009 | Krewalk et al. | 473/328 |
| 7,819,755 | B2 * | 10/2010 | Sugimae et al. | 473/308 |
| 8,328,658 | B2 * | 12/2012 | Bennett et al. | 473/328 |
| 2002/0042305 | A1 * | 4/2002 | Otoguro | 473/328 |
| 2002/0094882 | A1 * | 7/2002 | Nagai et al. | 473/328 |
| 2003/0060304 | A1 * | 3/2003 | Fitzmaurice | 473/328 |
| 2004/0048684 | A1 * | 3/2004 | Herber | 473/328 |
| 2004/0116204 | A1 * | 6/2004 | Fitzmaurice | 473/328 |
| 2004/0152537 | A1 * | 8/2004 | Moore, Jr. | 473/328 |
| 2005/0049073 | A1 * | 3/2005 | Herber | 473/328 |
| 2006/0094526 | A1 * | 5/2006 | Reed | 473/328 |
| 2006/0094527 | A1 * | 5/2006 | Evans | 473/328 |
| 2006/0240905 | A1 * | 10/2006 | Haney et al. | 473/313 |
| 2007/0105645 | A1 * | 5/2007 | Thompson | 473/328 |

* cited by examiner

GOLF CLUB WITH TROUGH IN SOLE

CROSS-REFERENCE TO RELATED APPLICATIONS

This application is a continuation of U.S. patent application Ser. No. 12/570,725, filed Sep. 30, 2009, now pending, and incorporated herein by reference in its entirety.

FIELD OF THE INVENTION

The present invention relates generally to a golf club containing a plurality of rails on its sole. More specifically, the present inventions relates to a metal wood type golf club head having a plurality of rails on its sole allowing for improved turf interaction as well as provide adjustments to the lie angle of the metal wood type golf club head. Even more specifically, the present invention relates to a metal wood type golf club head wherein the golf club head is capable of changing the lie angle of the golf club head by varying the combination of rails on the sole of the metal wood type golf club head that comes into contact with the ground.

BACKGROUND OF THE INVENTION

Golf club designs have been very diverse in order to achieve various performance objectives within the game of golf. For example, driver type golf clubs have been designed to maximize the distance of a golf shot, especially when the golf ball is sitting in a good lie on top of a tee. On the other side of the spectrum, putter type golf clubs have been designed to maximize accuracy for short precise shots on the putting green in order to get the golf ball into the cup. Mixed in between driver type golf clubs and putter type golf clubs are numerous other club designs such as fairway wood type golf clubs, hybrid type golf clubs, iron type golf clubs, and even wedge type golf clubs. Each of the above mentioned types of golf clubs have specific design objectives which achieve the correct balance of distance and accuracy for the specific types of golf shot that is desired.

When a golfer is not utilizing a tee, the various types of landing spots of a golf ball will generally greatly affect the club selection as well as finding the correct balance between distance and accuracy. These golf shots not executed from a tee box will vary from one another depending on the surface conditions from which the golf ball needs to be struck. Regardless of which kind of surface condition a golfer is faced with, these various surface conditions all tend to affect the performance of a golf club as the club attempts to strike a golf ball resting on such a surface. In one scenario, the golf ball could be sitting in a rough area containing high and tall grass creating a high coefficient of friction between the grass and the golf club. This increased coefficient of friction dramatically reduces the speed of a golf club as it comes into contact with the golf ball, resulting in slower clubhead speed as the club head. In fact, even if a golf ball is not sitting in tall grass with a high coefficient friction, a golf ball resting on any other grassy surface will offer up some resistance when the golf club comes into contact with the grassy ground. These types of various surface conditions could very well reduce the speed of the golf swing through varying degrees of coefficient of friction and may even deflect the potential direction of travel of a golf club from its desired path. This deflection, although generally minimal, could significantly impair the accuracy of a golf shot because it causes the golf club to be pointed away from the intended target line during impact.

This frictional interaction between the golf club and the ground may generally be known as "turf interaction" within the golf industry. Although certain particular situations will require an increased turf interaction between the golf club and the ground, it is generally desirable to minimize the turf interaction between the golf club and the ground. In order to minimize the amount of energy lost due to frictional turf interaction when the golf club interacts with the ground, various shapes and sizes of the golf club sole has been developed to reduce the contact area; hence reducing the coefficient of friction between the golf club and the ground. These methods of merely altering sole shape, although capable of slightly improving the turf interaction, still leave a very large sole profile coming into contact with the ground, making them unsatisfactory in terms of truly minimizing turf interaction.

U.S. Pat. No. 1,669,482 to Miller titled Golf Club ('482 patent) addresses the above shortcomings by disclosing an improved methodology to truly minimize turf interaction while reducing coefficient of friction and energy loss between a golf ball and the ground. More specifically, the '482 patent discloses a club having a rib or heel at the sole for driving a golf ball which shall have means on the bottom face or sole of its head to engage the turf during a part of the sole of the club. The head according to the '482 patent will generally be guided in the direction of intended flight of the ball and will follow the same a short distance with the result that the ball is driven true and straight and has imparted thereto a spin that increase the rolling action thereof upon landing from its flight.

Alternatively, U.S. Pat. No. 4,332,388 to Crow titled Golf Club Head ('388 patent) discloses an alternative means to address the above mentioned shortcomings utilizing a pair of spaced parallel runners. More specifically, the '388 patent discloses a club with a sole plate, wherein the sole plate has a pair of spaced parallel runners projecting downwardly and extending from front to rear across the full width of the plate. The runners are substantially semicircular in cross section and are quite large compared to ribbed or grooved structures which have been used.

Although both the '482 patent and the '388 patent are capable of reducing the coefficient of friction and energy loss of a golf club as it comes into contact with a ground, the sole profiles are only suitable for use when the ground is completely flat and without any undulations. Golfers who play golf may attest to the fact that golf courses are generally filled with uneven landscaping and uneven undulations, making the need to execute a golf shot from an uneven lie just as important as the ability to do so from a completely flat lie. The '482 patent and the '388 patent, with their singular rib or pair of parallel runners, are unable to reduce the coefficient of friction and energy loss when a golfer needs to hit a golf shot from an uneven lie as their sole rib or runners only run in one plane.

In order to address the need of a golfer to execute a golf shot that also minimizes turf interaction for uneven lies, it may be desirable to have a golf club that contain a sole profile that contains a plurality of rails with some being at different angles to allow the club head to compensate for such uneven lies. It may also be desirable to utilize such a lie angle adjustment independently of the slope of the ground, in order to provide a golf club head that's capable of sitting upright or flat irrespective of the lie. Finally, it may also be desirable for such a club to be paired with an adjustable hosel to allow for ease of adjustment of the lie angle, face angle, or any other angles necessary to take full advantage of the sole profile.

It can be seen from the above that there is a need for a golf club that is capable of improving turf interaction with the ground regardless of whether the golf ball sits on a perfectly flat lie or an uneven lie. Hence it can also be seen, there is tremendous advantage in the field for a golf club that contains a sole profile that allow for the golf club to sit properly at different lie angles and yielding minimal turf interaction at different lie angles. More specifically, there is a need in the field for a golf club containing a plurality of rails on the sole that are angled in such a way to allow for the golf club head to have a change in lie angle when different combination of the plurality of rails are in contact with the ground.

BRIEF SUMMARY OF THE INVENTION

One aspect of the present invention is directed to a golf club head comprising a striking face for striking a golf ball, a crown extending rearwardly from an upper portion of the striking face and a sole extending rearwardly from a lower portion of the striking face. The sole of the golf club further comprises a plurality of rails protruding from the sole while running longitudinally from the striking face toward a rear portion of the golf club head. The plurality of rails are arranged in such a way to allow for the golf club head to change its lie angle utilizing different combination of the above mentioned plurality of rails to come into contact with the ground.

In another aspect of the present invention, a golf club head includes of a striking face for striking a golf ball, a crown extending rearwardly from an upper portion of the striking face and a sole extending rearwardly from a lower portion of the striking face. The sole of the golf club head further includes a plurality of rails protruding from the sole while running longitudinally from the striking face toward a rear portion of the golf club head. The plurality of rails further includes a first rail located near a toe portion of the sole, a second rail located near the center portion of the sole with a slight toe bias, a third rail located near the center portion of the sole with a slight heel bias, and a fourth rail located near heel portion of the sole.

In a further aspect of the present invention, a golf club includes of a club head having a volume ranging from about 100 cubic centimeters to about 470 cubic centimeters, a mass ranging from about 175 grams to about 260 grams, and a loft ranging from about 9 degrees to about 28 degrees. The golf club also has a shaft connected to a heel portion of the golf club head with the shaft having a mass ranging from about 50 grams to about 110 grams. The golf club also has a ferrule juxtaposed between the golf club head and the shaft with the ferrule having a mass ranging from about 30 grams to about 50 grams. The total club length of the golf club ranges from about 39 inches to about 46 inches, with the sole of the golf club head further comprising of a plurality of rails protruding from the sole and arranged in such a way to allow for the golf club head to change its lie angle utilizing a different combination of the above plurality of rails to contact the ground.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed descriptions the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
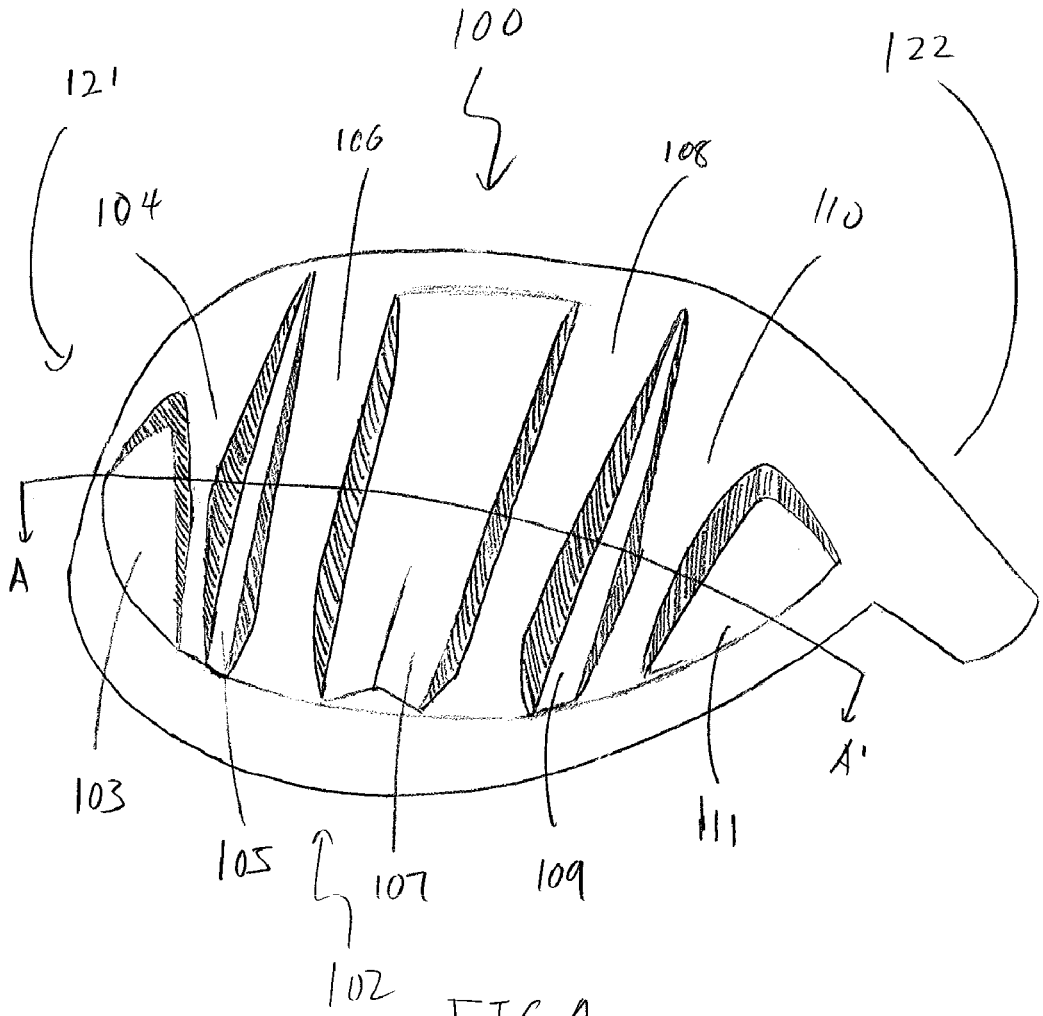
FIG. 1 shows a prospective view of a golf club head in accordance with the present invention.

FIG. 1 here shows a prospective view of a metal wood type golf club head 100 in accordance with an exemplary embodiment of the present invention. Metal wood type golf club head 100, as shown in FIG. 1, may contain a plurality of rails 104, 106, 108, and 110 on the sole 102 portion of the metal wood type golf club head 100. The plurality of rails 104, 106, 106, and 108 shown can be more specifically identified as a first rail 104, a second rail 106, a third rail 108, and a fourth rail 110. The first rail 104, as shown in the current exemplary embodiment, may generally be positioned on the toe portion 121 of the sole 102 of the metal wood type golf club head 100. The second rail 106, as shown in the current exemplary embodiment, may generally be located near a center portion of the sole 102 of the metal wood type golf club head 100 with a slight toe 121 bias. The third rail 108, as shown in the current exemplary embodiment, may generally be located near a center portion of the sole 102 of the metal wood type golf club head 100 with a slight heel 122 bias. Finally, the fourth rail, as shown in the current exemplary embodiment, may generally be positioned on the heel portion 122 of the sole 102 of the metal wood type golf club head 100.

Plurality of rails 104, 106, 108, and 110, as shown in the current exemplary embodiment, may generally be located along the sole 102 portion of the metal wood type golf club head 100. Having a plurality of rails 104, 106, 108, and 110 on the sole 102 portion of the metal wood type golf club head 100 decreases the total surface area of the sole 102 that comes into contact with a ground, thus minimizing turf interaction. Turf interaction may generally be a result of the coefficient of friction between the sole 102 of a golf club and the ground.

This turf interaction may generally be an undesirable characteristic as it may slow down the speed of the metal wood type golf club head 100 as it glides through the ground preparing for impact with a golf ball. In addition to slowing down the speed of the metal wood type golf club head 100, turf interaction may also alter the direction of travel of the metal wood type golf club head 100, hence altering the direction of travel of a golf ball away from the intended path. Although the current exemplary embodiment may depict a metal wood type golf club head 100 containing four rails 104, 106, 108, and 110, the present invention may include any plurality of rails so long as the rails are used to minimize turf interaction all without departing from the scope and content of the present invention.

The plurality of rails 104, 106, 108, and 110 shown in the current exemplary embodiment may generally look like protrusions extending from the bottom of the sole 102 of the metal wood type golf club head 100, separated by troughs 103, 105, 107, 109, and 111. The troughs 103, 105, 107, 109, and 111, as shown in the current exemplary embodiment, may generally take on various shapes and sizes with various angles and depths without departing from the scope and content of the present invention, so long as they are capable of creating a distinct separation between the plurality of rails 104, 106, 108, and 110. The plurality of rails 104, 106, 108, and 110, as shown in the current exemplary embodiment, may also take on various shapes and sizes containing various angles and depths without departing from the scope and content of the present invention so long as they work in conjunction with the troughs 103, 105, 107, 109, and 111 to decrease the total surface area of the sole 102 that comes in contact with the ground.

Although the plurality of rails 104, 106, 108, and 110 shown in the current exemplary embodiment may be comprised of the same material as the remainder of the golf club head 100, the plurality of rails 104, 106, 108, and 110 may be comprised of a different material without departing from the scope and content of the present invention.

Figure 2A:
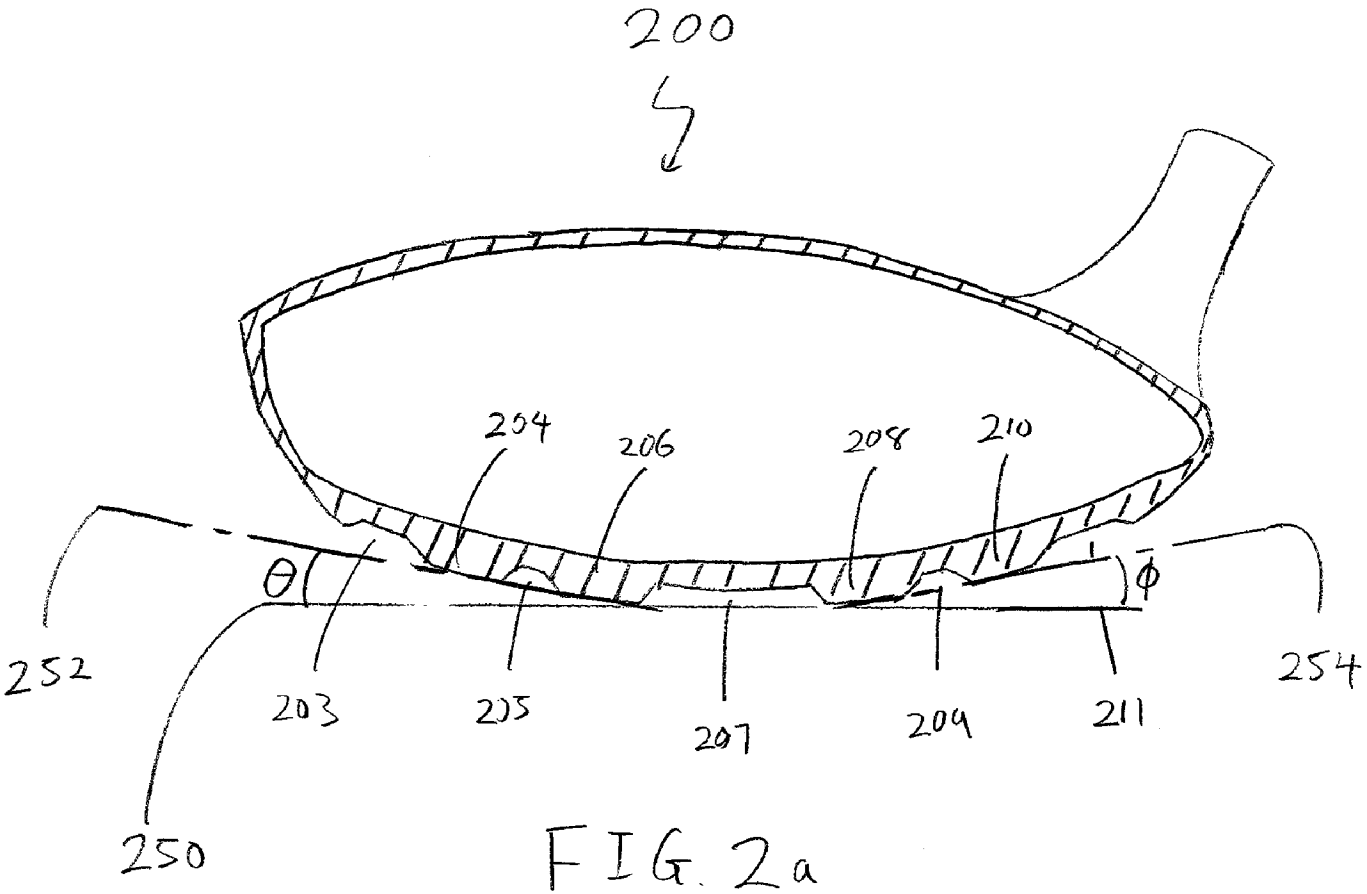
FIG. 2*a* shows a cross-sectional view of a golf club head in accordance with the present invention taken along cross-sectional line A-A' as shown in FIG. 1.

FIG. 2*a* shown here is a cross-sectional view of metal wood type golf club head 100 taken along cross-sectional line A-A' as shown in FIG. 1. The cross-sectional view of metal wood type golf club head 200, as shown in the current FIG. 2*a*, is capable of showing the various positions that the metal wood type golf club head 200 that could interact with the ground 250 utilizing a plurality of rails 204, 206, 208, and 210. Here, in the neutral position, metal wood type golf club head 200 may generally sit neutrally on a perfectly even lie on ground 250 utilizing the second rail 206 and the third rail 208. When the metal wood type golf club head 200 rests on the second rail 206 and the third rail 208, it minimizes the surface area of the metal wood type golf club head 200 that comes in contact with the ground 250. This minimized contact area allows the metal wood type golf club head 200 to reduce the coefficient of friction between the metal wood type golf club head 200 and the ground 250, especially when the ground 250 is on a perfect lie as shown in FIG. 2*a*. This reduced coefficient of friction may generally minimize turf interaction between the metal wood type golf club head 200 and the ground 250 minimizing the reduction in club head speed as well as minimizing undesirable deflection of the metal wood type golf club head 200 all resulting in improved performance.

In order to compensate for uneven lies that could result from a golf ball sitting in an uphill incline or a downhill decline, metal wood type golf club head 200 is designed in a way that could utilize different combination of its plurality of rails 204, 206, 208, and 210 to adjust for changes in lie angle. FIG. 2*a* shows a good example of the metal wood type golf club head 200 interacting with an uphill incline ground 252 at an angle of θ. In this exemplary embodiment, when the metal wood type golf club head 200 is used to hit a golf ball sitting at an uphill incline, the metal wood type golf club head 200 would utilize the first rail 204 and the second rail 206 to rest on the uphill inclined ground 252 as shown in FIG. 2*a*. Utilizing the first rail 204 and the second rail 206 as the contact points of the metal wood type golf club head 200 allows it to sit more flat, allowing the metal wood type golf club head 200 to sit properly relative to an uphill inclined ground 252. Similar to as if the metal wood type golf club head 200 was sitting on a neutral lie ground 250, this minimized contact area between the first rail 204 and the second rail 106 with the uphill inclined ground 252 may also reduce coefficient of friction, thus minimizing turf interaction while improving performance in an uneven uphill lie. Metal wood type golf club head 200 may generally be able to account for an uphill lie angle θ change of less than 25 degrees flatter relative to the neutral lie ground 250, more preferably less than about 20 degrees flatter relative to the neutral lie ground 250, and more preferably less than about 15 degrees flatter relative to the neutral lie ground 250.

Alternatively, FIG. 2*a* also shows the metal wood type golf club head 200 interacting with a downhill decline ground 254 at an angle of Φ. In this exemplary embodiment, when the metal wood type golf club head 200 is used to hit a golf ball sitting at a downhill incline, the metal wood type golf club head 200 would utilize the third rail 208 and the fourth rail 210 to rest on the downhill decline ground 254 as shown in FIG. 2*a*. Utilizing the third rail 208 and the fourth rail 210 as the contact points of the metal wood type golf club head 200 allows it to sit more upright, thus allowing the metal wood type golf club head to sit properly relative a downhill decline ground 254. Similar to as if the metal wood type golf club head 200 was sitting on a neutral lie ground 250, this minimized contact area between the third rail 208 and the fourth rail 210 with the downhill declined ground 254 may also reduce coefficient of friction, thus minimizing turf interaction while improving performance. Metal wood type golf club head 200 may generally be able to account for a lie angle θ change of less than about 25 degrees more upright relative to the neutral lie ground 250, more preferably less than about 20 degrees more upright relative to the neutral lie ground 250, and more preferably less than about 15 degrees more upright relative to the neutral lie ground 250.

Figure 2B:
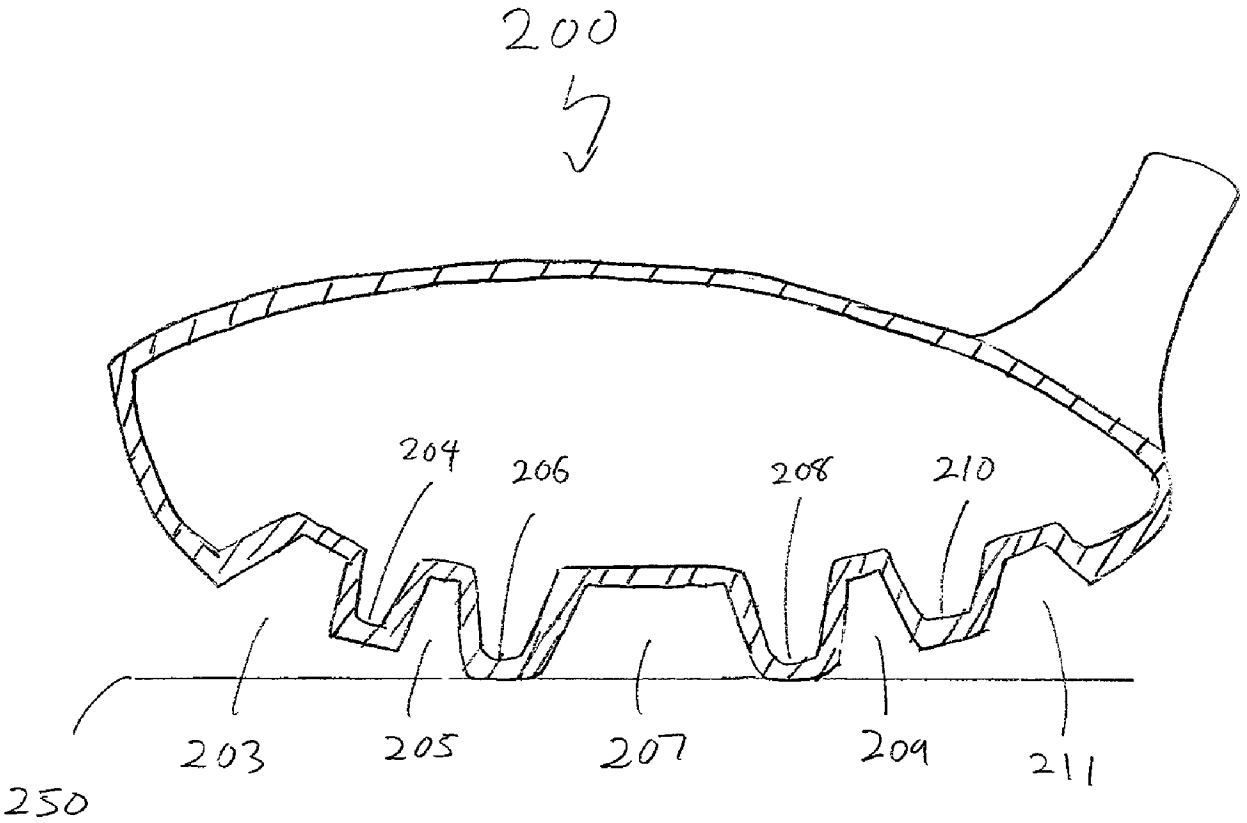
FIG. 2*b* shows a cross-sectional view of a golf club head in accordance with an alternative embodiment of the present invention taken along cross-sectional line A-A' in FIG. 1.

FIG. 2*b* shows an alternative embodiment of the present invention wherein the plurality of troughs 203, 205, 207, 209, and 211 are significantly deeper. Deeper troughs 203, 205, 207, 209, and 211 may generally be beneficial in a metal wood type golf club head 200 when it is used to interface with taller grass. More specifically, having deeper troughs 203, 205, 207, 209, and 211 will allow for the golf club head to go deeper into the tall grass, allowing the metal wood type golf club head 200 to better engage a golf ball that would be sitting on such a tall grass. Metal wood type golf club head 200, as shown in this current exemplary embodiment could also have the plurality of rails 204, 206, 208, and 210 be comprised of a tungsten like material that helps lower the center of gravity of the golf club head 200 to improve performance; however, numerous other materials may be used besides tungsten such as aluminum, titanium, or even different steel compositions all without departing from the scope and content of the present invention.

Figure 3:
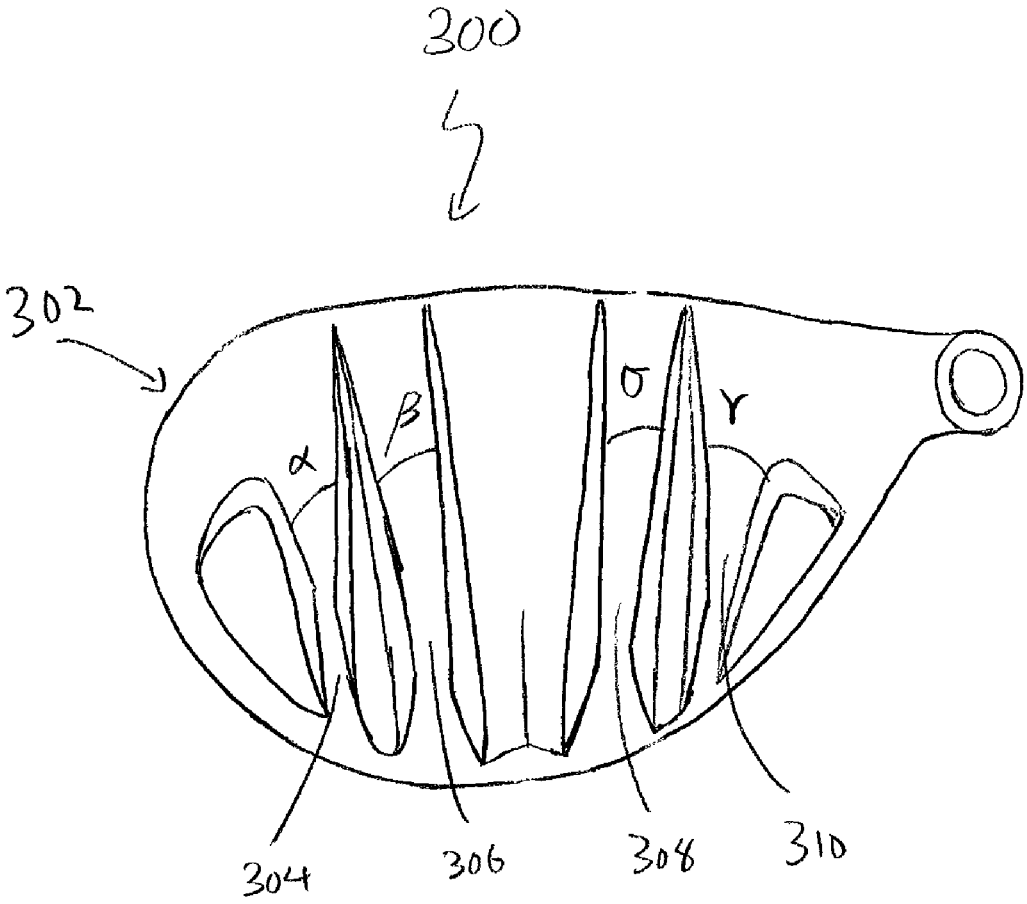
FIG. 3 shows a top view of the sole profile of a golf club head in accordance with the present invention.

FIG. 3 here shows a top view of the sole 302 of a metal wood type golf club head 300 in accordance with an exemplary embodiment of the present invention. The top view of the metal wood type golf club head 300 is capable of showing the relative angles of the plurality of rails 304, 306, 308, and 310 as they appear on the sole 302 of the metal wood type golf club head 300. The relative angles formed by each of the plurality of rails 304, 306, 308, and 310 help maintain resting position of the metal wood type golf club head 300 when it is adjusted for different lie angles as described above. More specifically, the first rail 304 may generally have an offset angle α, the second rail 306 may generally have an offset angle β, the third rail 308 may generally have an offset angle σ, and the fourth rail 310 may generally have an offset angle γ. In a further alternative embodiment of the present invention, these offset angles α, β, σ, and γ, may also be used to even adjust the face angle of the metal wood type golf club head 300 in conjunction with the adjustment of lie angle without departing from the scope and content of the present invention. Because of the complicated cosmetic graphics associated with the sole 302 profile of the metal wood type golf club head 300, FIG. 4 is created below to better illustrate the various offset angles α, β, σ, and γ utilizing plain geometric shapes for explanatory purposes.

Figure 4:
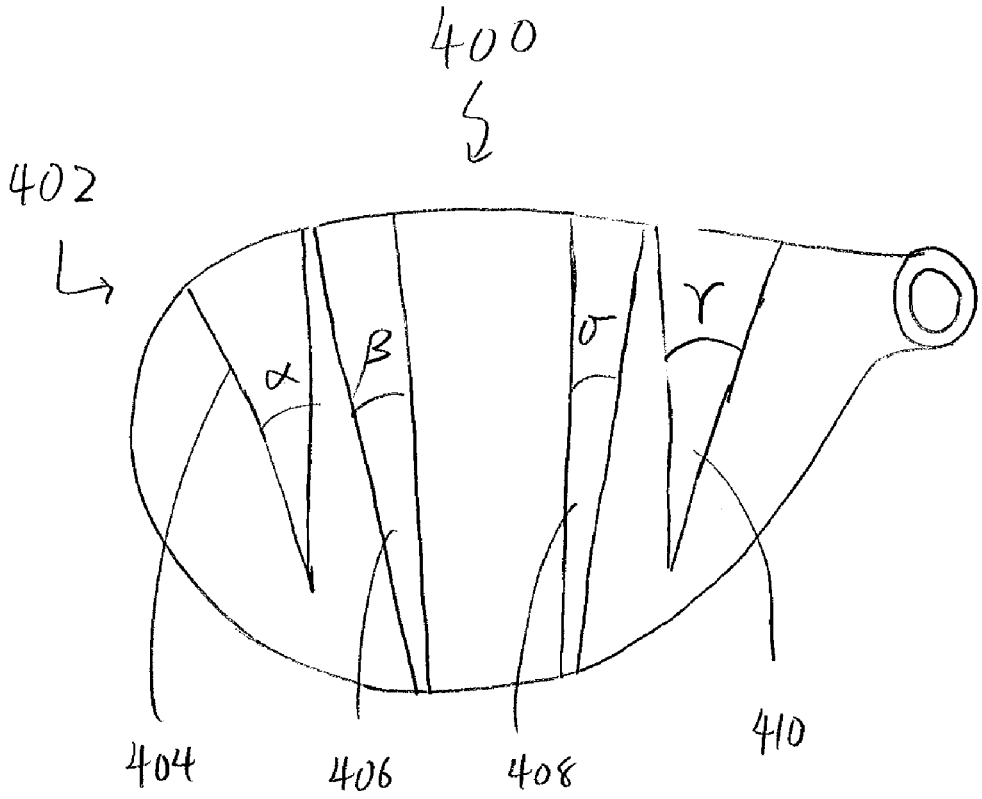
FIG. 4 shows a simplified geometric representation of the sole profile of a golf club head in accordance with the present invention for illustrative purposes.

Turning now to FIG. 4 showing a top view of the sole 402 of a metal wood type golf club head 400 with simplified geometric shapes 404, 406, 408, and 410 to represent the plurality of rails 304, 306, 308, and 310 respectively as shown in FIG. 3. Simplified geometric shapes 404, 406, 408, and 410 allows for easier visual identification of the offset angles α, β, σ, and γ, which help maintain or adjust the face angle of the metal wood type golf club head 400 to work in conjunction with the lie angle adjustment.

Offset angle α as shown in the current exemplary embodiment may generally range from about 15 degrees to about 25 degrees, more preferably between about 17.5 degrees to about 22.5 degrees, and most preferably about 21 degrees. Offset angle β, as shown in the current exemplary embodiment may generally range from about 5 degrees to about 15 degrees, more preferably from about 7.5 degrees to about 12.5 degrees, and most preferably about 13 degrees. Offset angle α in conjunction with offset angle β may help close the face angle of the metal wood type golf club head 400 when the metal wood type golf club head 400 is placed in a flat lie position with the first rail 404 and the second rail 406 coming into contact with the ground.

Offset angle σ, as shown in the current exemplary embodiment may generally range from about 5 degrees to about 15 degrees, more preferably from about 7.5 degrees to about 12.5 degrees, and most preferably about 13 degrees. Offset angle β in conjunction with offset angle σ may keep the face angle of the metal wood type golf club head 400 fairly neutral when the metal wood type golf club head 400 is placed in a neutral lie position with the second rail 406 and the third rail 408 coming into contact with the ground.

Finally, offset angle γ, as shown in the current exemplary embodiment may generally range from about 15 degrees to about 25 degrees, more preferably between about 17.5 degrees to about 22.5 degrees, and most preferably about 21 degrees. Offset angle σ in conjunction with offset angle γ may help open the face angle of the metal wood type golf club head 400 when the metal wood type golf club head is placed in the upright lie position with the third rail 408 and the fourth rail 410 coming into contact with the ground.

Looking at the adjustment capabilities of the metal wood type golf club head 400, we can see that the plurality of rails 404, 406, 408, and 410 may be used to adjust both the lie angle and the face angle of the metal wood type golf club head 400. Consequently, it would be beneficial to quantify this change as "a face angle to lie angle adjustment ratio". This face angle to lie angle adjustment ratio may be further defined by Equation 1 below:

$$\text{Face angle to lie angle adjustment ratio} = (\text{face angle change})/(\text{lie angle change}) \quad \text{(Eq. 1)}$$

It should be noted that the face angle change, as shown in the current exemplary embodiment above, may generally be from about 15 degrees to about 25 degrees judging from offset angles αβ, σ, and γ as shown in FIG. 4. Lie angle change, as shown in the current exemplary embodiment above, may generally be from about 15 degrees to about 45 degrees, judging from θ and Φ as shown in FIG. 2*a*. In this current exemplary embodiment, utilizing the figures above, the face angle to lie angle adjustment ratio may generally be from about 0.5 to about 1.0 in order to quantify the combination of the face angle and lie angle adjustment capable of by the metal wood type golf club head 400.

Figure 5:
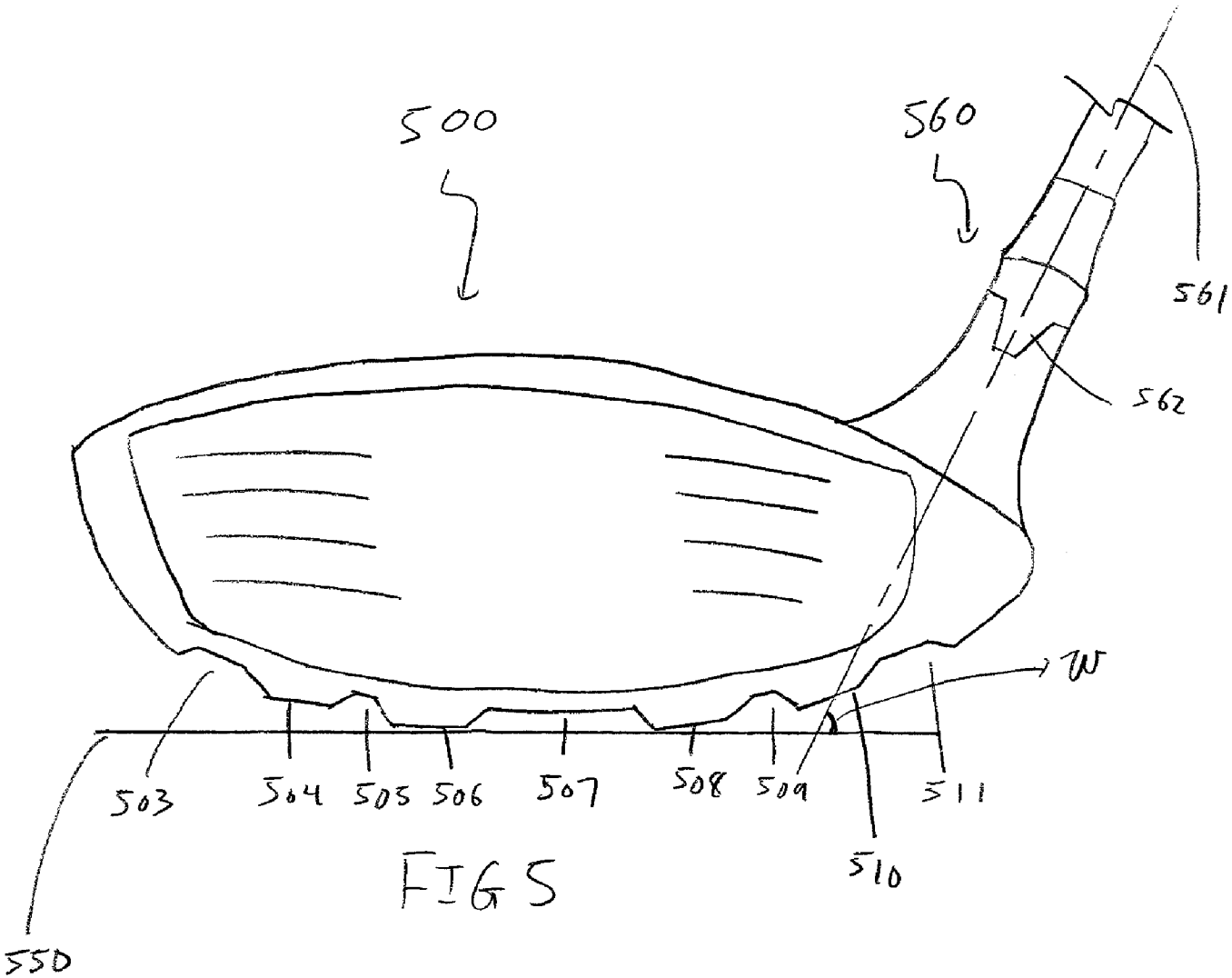
FIG. 5 shows a front view of a golf club head in accordance with an alternative embodiment of the present invention.

FIG. 5 shows a front view of an even further alternative embodiment of the present invention wherein the metal wood type golf club head 500 incorporates an adjustable hosel 560 that yields a shaft axis 561 forming a lie angle ω. with the ground 550. This adjustable hosel 560 may generally allow the face angle and lie angle of the metal wood type golf club head 500 to change according to the position of the notches 562 of the adjustable hosel 560. In this current setting, the adjustable hosel 560, being in its neutral setting, will allow the metal wood type golf club head 500 to sit neutrally on the ground 550 with the second rail 506 and the third rail 508 coming into contact with the ground 550. The details of such an adjustable hosel 560 could be found in U.S. patent application Ser. No. 12/493,517, the disclosure of which is incorporated by reference in its entirety.

Figure 6:
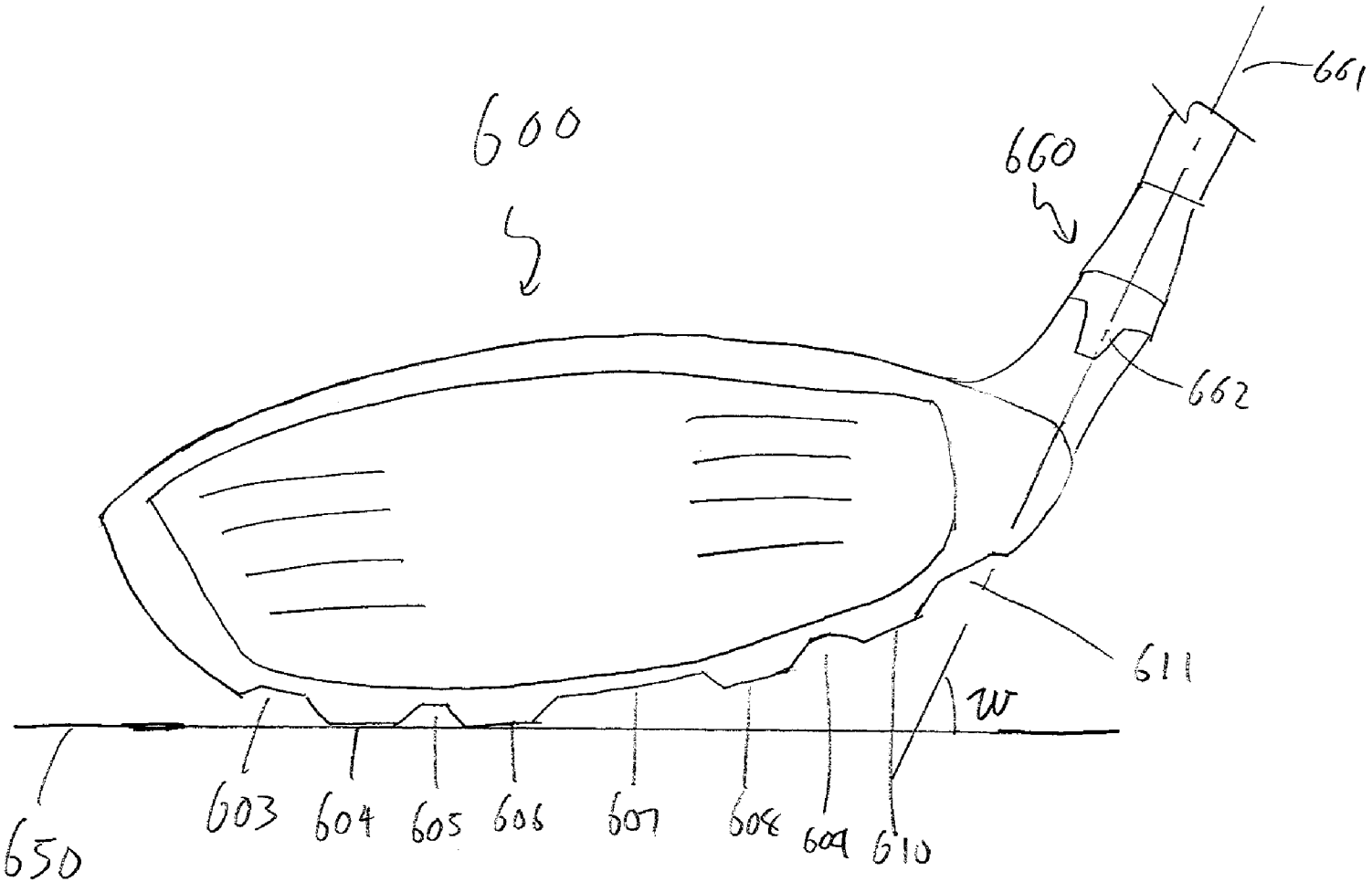
FIG. 6 shows a front view of a golf club head in accordance with an alternative embodiment of the present invention.

FIG. 6 shows an alternative embodiment of the present invention wherein metal wood type golf club head 600 containing an interchangeable hosel 660 is adjusted to sit flatter on the first rail 604 and the second rail 606. It should be noted that in this current exemplary embodiment, the metal wood type golf club head 600 is not sitting on an uphill sloped ground 650 despite resting in a flatter position with the first rail 604 and the second rail 606 in contact with a flat ground 650. The adjustable hosel 660, as shown in the current exemplary embodiment, may generally allow the metal wood type golf club head 600 to sit flatter on the ground 650 while maintaining the same lie angle ω with the ground 650. It should be noted that under this flatter setting of the adjustable hosel 660, the metal wood type golf club head 600 may also have a change in face angle to accompany the change in lie angle without departing from the scope and content of the present invention.

Figure 7:
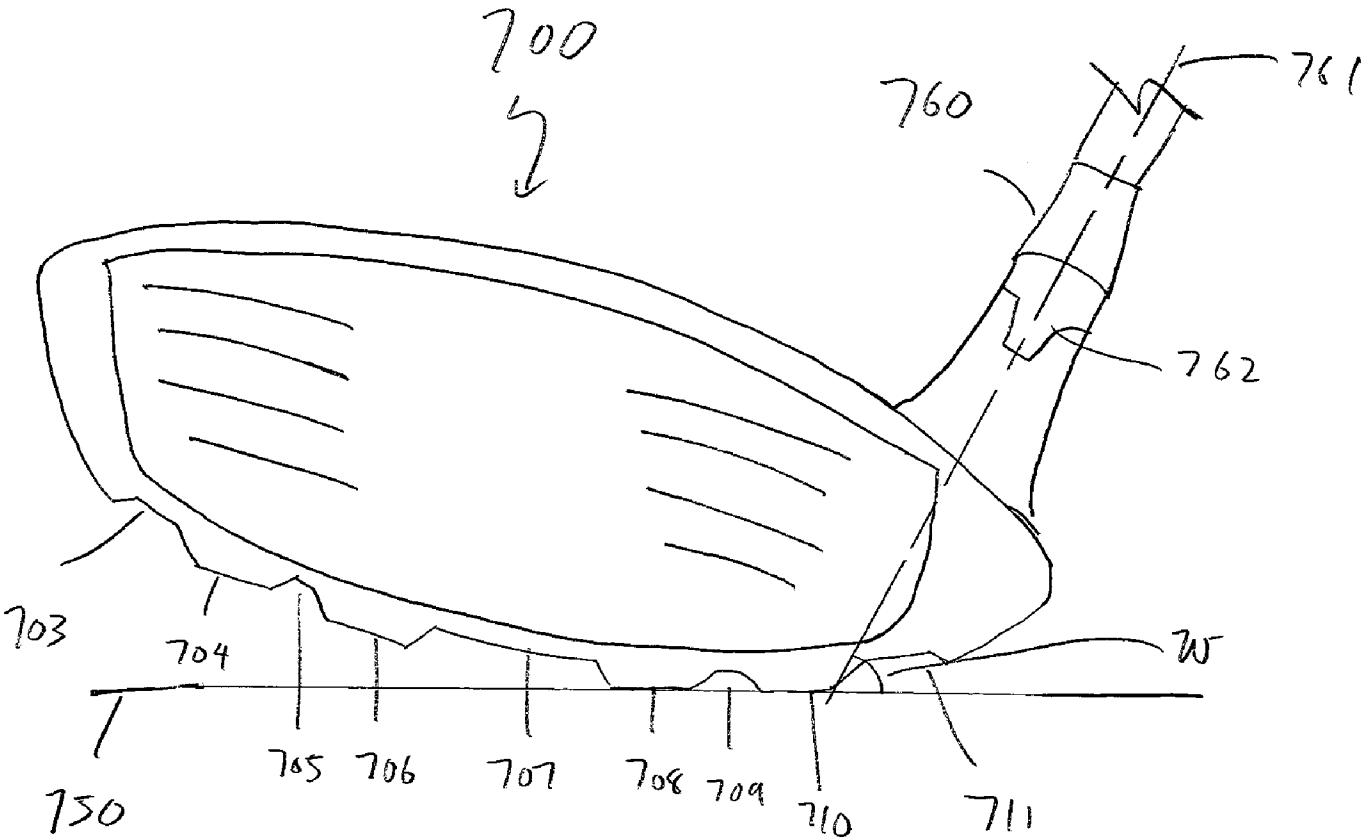
FIG. 7 shows a front view of a golf club head in accordance with an alternative embodiment of the present invention.

FIG. 7 shows an alternative embodiment of the present invention wherein metal wood type golf club head 700 containing an interchangeable hosel 760 is adjusted to sit more upright on the third rail 708 and fourth rail 710. It should be noted that in this current exemplary embodiment, the metal wood type golf club head 700 is not sitting on a downhill sloped ground 750 despite resting in a more upright position with the third rail 708 and the fourth rail 710 in contact with a flat ground 750. The adjustable hosel 760, as shown in the current exemplary embodiment, may generally allow the metal wood type golf club head 700 to sit more upright on the ground 750 while maintaining the same lie angle ω with the ground 750. It should be noted that under this more upright setting of the adjustable hosel 760, the metal wood type golf club head 700 may also have a change in the face angle to accompany the change in lie angle without departing from the scope and content of the present invention.

Figure 8:
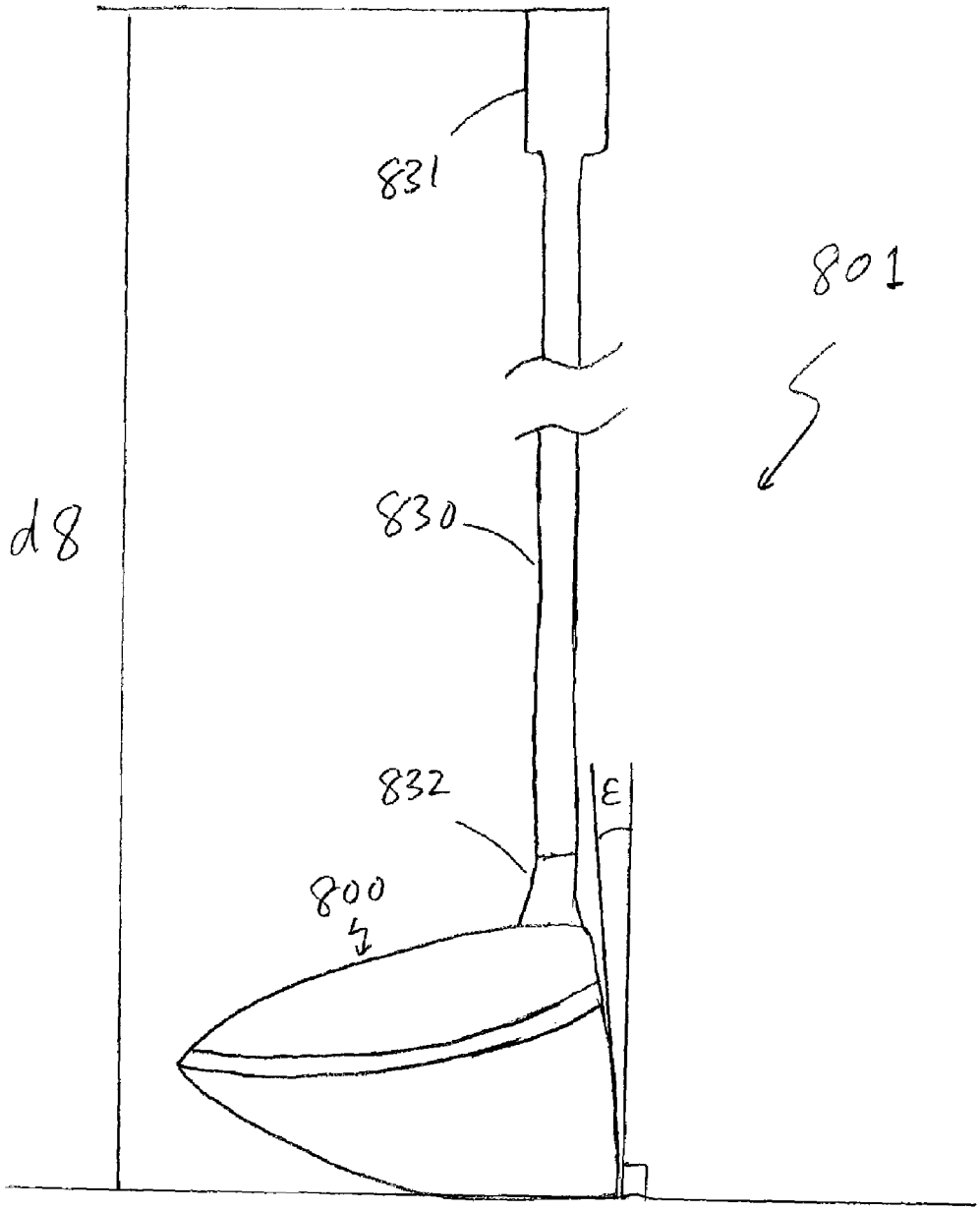
FIG. 8 shows a prospective view of an entire golf club in accordance with an embodiment of the present invention.

FIG. 8 shows side view of the entire metal wood type golf club containing not only the metal wood type golf club head 800, but also includes a shaft 830, a grip 831 as well as a ferrule 832. First and foremost, it should be noted that the current metal wood type golf club head 800 may generally have a volume of from about 100 cubic centimeters to about 470 cubic centimeters to allow for the metal wood type golf club head 800 to achieve a sufficiently large size with a sole profile to warrant the need for rails. Additionally, metal wood type golf club head 800, due at least in part to its increased volume, may generally have a mass of about 175 grams to about 260 grams. Finally, because such kind of metal wood type golf club heads 800 may be used to execute a wide variety of shots, they may generally have a loft angle $\epsilon$ of from about 9 degrees to about 28 degrees. Connected to the metal wood type golf club head 800 is a ferrule 832, which in the current exemplary embodiment, may generally weight about 1.0 grams to about 2.5 grams. Ferrule 832 weight is important in a metal wood type golf club 801 design, as it is a method to adjust the swing weight of the golf club 801 without adversely affecting the Center of Gravity (CG) location of the metal wood type golf club head 800 due to the fact that the ferrule 832 is located along the shaft axis.

FIG. 8 also shows a shaft 830 connected to the ferrule 832 and the metal wood type golf club head 800. The shaft 830, as shown in the current exemplary embodiment, may generally have a mass ranging from about 50 grams to about 110 grams to compensate for the various swing characteristics of the golf club 801. Finally, connected to a distal end of the golf club 801, is a grip having a mass of about 30 grams to about 50 grams that may be capable of adjusting the swing weight of the golf club 801. The totality of the components may generally yield a club length d8 of from about 39 inches to about 46 inches to help achieve the proper balance of distance and accuracy between the various club combinations.

Other than in the operating example, or unless otherwise expressly specified, all of the numerical ranges, amounts, values and percentages such as those for amounts of materials, moment of inertias, center of gravity locations, loft, draft angles, various performance ratios, and others in the following portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:
an adjustable hosel;
a striking face for striking a golf ball;
a crown extending rearwardly from an upper portion of the striking face; and
a sole extending rearwardly from a lower portion of the striking face, the sole comprising at least two protrusions running from a face side of the sole to a rear side of the sole and separated by a trough, wherein the trough is wider at the face side of the sole than at the rear side of the sole.

2. The golf club head of claim 1, wherein the protrusions comprise edges that run substantially straight from the face side of the sole to the rear side of the sole.

3. The golf club head of claim 1, wherein a face angle of the club head can be adjusted with the adjustable hosel.

4. The golf club head of claim 1, wherein a lie angle of the club head can be adjusted with the adjustable hosel.

5. The golf club head of claim 1, wherein the lower portion of the striking face comprises a bottom edge, and the bottom edge is above a flat surface when the golf club head is sitting in a neutral position on the flat surface.

6. The golf club head of claim 1, wherein the golf club head comprises a loft angle ranging from about 9 degrees to about 28 degrees.

7. The golf club head of claim 1, wherein the golf club head has a mass ranging from about 175 grams to about 260 grams.

8. The golf club head of claim 1, wherein the protrusions decrease the surface area of the sole that comes into contact with the ground when the golf ball is struck.

9. The golf club head of claim 1, wherein the volume of the head is less than 300 cc.

10. The golf club head of claim 1, wherein said sole comprises a plurality of protrusions separated by a plurality of troughs.

11. A golf club head comprising:
an adjustable hosel;
a striking face for striking a golf ball;
a crown extending rearwardly from an upper portion of the striking face; and
a sole extending rearwardly from a lower portion of the striking face, the sole comprising at least two protrusions running from a face side of the sole to a rear side of the sole and separated by a trough, wherein a loft angle of the club head can be adjusted with the adjustable hosel.

12. A golf club head comprising:
an adjustable hosel;
a striking face for striking a golf ball;
a crown extending rearwardly from an upper portion of the striking face; and
a sole extending rearwardly from a lower portion of the striking face, the sole comprising at least two protrusions running from a face side of the sole to a rear side of the sole and separated by a trough, wherein the golf club head comprises a face angle ranging from about 15 degrees to about 25 degrees open.

13. A golf club head comprising:
an adjustable hosel;
a striking face for striking a golf ball;
a crown extending rearwardly from an upper portion of the striking face; and
a sole extending rearwardly from a lower portion of the striking face, the sole comprising at least two protrusions running from a face side of the sole to a rear side of the sole and separated by a trough, wherein the golf club head has a face angle to lie angle adjustment ratio of between about 0.5 to about 1.0, wherein the face angle to lie adjustment ratio is defined as a face angle change divided by a lie angle change.

* * * * *